US006619593B1

(12) United States Patent
Callahan

(10) Patent No.: US 6,619,593 B1
(45) Date of Patent: Sep. 16, 2003

(54) TRAIN NOISE ELIMINATION SYSTEM

(76) Inventor: Timothy Allen Callahan, 5994 White Pine Dr., Bedford Heights, OH (US) 44146

( * ) Notice: Subject to any disclaimer, the term of this patent is extended or adjusted under 35 U.S.C. 154(b) by 0 days.

(21) Appl. No.: 10/008,562

(22) Filed: Nov. 13, 2001

(51) Int. Cl.[7] ..... B61L 23/00
(52) U.S. Cl. ..... 246/115
(58) Field of Search ..... 246/111, 114 A, 246/115, 117, 126, 127, 473.1, 477

(56) References Cited

U.S. PATENT DOCUMENTS 4,942,395 A * 7/1990 Ferrari et al. ..... 246/125
5,620,155 A * 4/1997 Michalek ..... 246/121
5,680,120 A * 10/1997 Tilleman ..... 246/106
5,890,682 A * 4/1999 Welk ..... 246/122 R

* cited by examiner

*Primary Examiner*—S. Joseph Morano
*Assistant Examiner*—Robert J. McCarry, Jr.

(57) ABSTRACT

A two-piece, compact wireless railroad grade crossing motorist warning device comprising: a transmitter that transmits a non-audible analog radar beacon signal to be installed on a train and a receiver to receive the non-audible analog radar beacon to be installed on a motor vehicle. The receiver warns the motor vehicle operator of the train approaching a nearby railroad highway intersection without substantially increasing the ambient noise level in the surrounding community adjacent to the intersection.

1 Claim, 4 Drawing Sheets

TRAIN NOISE ELIMINATION SYSTEM

BACKGROUND OF THE INVENTION

1. Field of the Invention

The present invention relates to safety systems that provide warning signals, in particular to safety systems that provide signals that provide warnings of on-coming trains approaching a nearby railroad highway intersection, and more particularly pertains to a "silent" warning system which alerts the operator of a vehicle when a train is approaching an railroad highway intersection without substantially increasing the ambient noise level of the surrounding neighborhood.

2. Description of the Prior Art

Noise has long been recognized as an environmental "pollutant" which can significantly compromise the quality of life in a number of ways, such as directly disturbing sleep and by interfering with daily activities. Furthermore, it is well established in the medical community, that prolonged exposure to excessive noise levels can lead to significant losses in hearing. Therefore, for at least these reasons, it is no surprise that neighborhood communities throughout the United States have established a variety of noise abatement programs that are explicitly designed to reduce the amounts of excessive ambient noise levels escaping into these neighborhood environments. Much success in reducing unwanted noise in neighborhoods near freeways has been achieved by simply erecting large walls that either reflect away or absorb freeway noise in order to minimize the ambient noise levels found in those surrounding neighborhoods. Innovative strategies, such as, restrictive placement of airports and even limiting the operating times an airport, have also proven to be effective strategies in minimizing unwanted noise levels in the surrounding neighborhoods. Unfortunately, little or no efforts has been attempted to limit the enhanced noise levels associated with the various warning systems used by railroad train systems to warn of their impending approach into railroad highway intersections. Time honored warning systems, such as, using train whistles or cross buck bell clangs to warn motorist have traditionally been an accepted nuisance to the non-motorist residents in the nearby adjacent communities. As a consequence, trains whistles may blow and train intersection cross bucks may clang at all hours of the day or night, and as a result adversely affect the quality of life and even lower the property values of the surrounding neighborhoods.

A number of different strategies have been implemented in the hopes of limiting ambient noise levels, however many of these strategies have simultaneously created a number of very undesirable consequences. For instance, present day automobile manufacturers are building soundproof vehicles so that the motoring consumer becomes effectively isolated from exterior audible sound sources. As a consequence, this trend in producing better sound proofed motor vehicles is likely to lead to more accidents because the motorist are likely to be unable to hear a given warning signal, such as not hearing a warning from a train whistle nor hear the incessant cross bucks clanging at a given railroad highway intersection. This noise avoidance strategy maybe further frustrated when operating various emergency vehicles because these vehicles themselves contribute to significant amounts of noise to the surrounding environment due to their blaring sirens. As a consequence of enabling sirens to emit loud warning signals, the emergency vehicle itself enhances the likelihood of creating a hazardous road condition because the siren noise coupled with the sound proof insulation of the emergency vehicle effectively blocks any other external noises from alerting the emergency vehicle motorist of any other external audible warning signal.

Since there are several hundred thousand railroad roadway intersections that exist in the United States, it is undisputed that it is important to provide a reliable and accurate means of warning motorist of an approaching train to prevent accidents. A 1975 study prepared for the U.S. Department for Transportation entitled "Feasibility Study of In-Vehicle Warning System"(DOT HS-801 569) confirms the importance of warning motorist by indicating that there are approximately 12,000 railroad crossing accidents annually. These train-motor vehicle accidents result in a tremendous cost to our society in terms of loss of lives, medical payments and increased expenses to railroads. These accidents occur even though these intersections are equipped with a conventional "cross buck" warning bell and light mounted pole that is expensive to build and to maintain. Furthermore, because of the expense in building and maintaining these "cross buck" warning systems, it has been estimated that well over one hundred thousand railroad roadway intersections in the United States alone have no warning system what so ever. As a consequence, approaching trains must blare their whistles in order to warn any nearby motorist of their imminent approach into these unprotected intersections. Therefore, to overcoming the technical drawbacks of the prior systems, there is a significant economic need for a simple, economic and reliable railroad crossing warning device.

The radio warning system for hazard avoidance disclosed by Smith in U.S. Pat. No. 6,160,493 provides a transmitter that calculates and subsequently transmits a digital radio data signal to a receiver which in turn deconvolutes this digital radio data signal and subsequently alerts the user of a potential hazardous condition through the use of an audible, visual or tactile alarm. Because the Smith disclosure necessarily requires relatively elaborate and sophisticated electronics to generate and eventually translate this digital radio data signal, the economic affordability of the Smith device is likely to limit acceptance of this device. In addition, due to the complexity of the electronic devices, the Smith disclosure may also be prone to frequent failures.

The train warning system disclosed by Ferrari in U.S. Pat. No. 5,729,213 provides a compact wireless railroad/highway crossing safety warning system that actively alerts motor vehicles operators and locomotive operators to potentially dangerous route conditions that may arise at a railroad intersection where the Ferrari disclosed invention is installed. Ferrari disclosure would require that at each railroad crossing intersection a pressure sensor, as well as, a beacon transmitter must be installed so that the pressure sensor can detect the on-coming train and subsequently activate the beacon so that the beacon can transmit a warning signal to any nearby vehicle that has a responsive receivers. Therefore, for the Ferrari disclosure to be an effective safety alert system in America's railroad system, every railroad crossing intersection in America would have this equipment installed at or near each intersection. As a consequence, the Ferrari disclosure suffers a number of serious drawbacks, in particular, the Ferrari disclosure appears to be economically infeasible due to the projected expenses in providing the necessary equipment as well as installing the equipment at each railroad intersection in America. Furthermore, the Ferrari disclosure also suffers from an inherent disadvantage of being prone to having vandals who could disrupt the installed equipment at any given railroad intersection.

The wireless train proximity alert system disclosed by Shirkey and Casella in U.S. Pat. No. 5,554,982 includes a transmitter mounted onto a train communicating to a crossing-based transceiver for receiving the transmitter signal that in turn communicates a warning signal to a vehicle-based receiver. Therefore, for the Shirkey and Casella disclosure to be an effective safety alert system in America's railroad system, every railroad crossing intersection in America would have this equipment installed at or near each intersection. As a consequence, the Shirkey and Casella disclosure suffers a number of serious drawbacks, in particular, the Shirkey and Casella disclosure appears to be economically infeasible due to the projected expenses in providing the necessary equipment as well as installing the equipment at each railroad intersection in America. Furthermore, the Shirkey and Casella disclosure also suffers from an inherent disadvantage of being prone to having vandals who could disrupt the installed equipment at any given railroad intersection.

The railway crossing collision avoidance system disclosed by Welk in U.S. Pat. No. 5,890,682 provides a tracking apparatus mounted onto a train which transmits a signal to a satellite communications receiver which in turn transmits a signal to a processor mounted at a railroad crossing so that an alarm may be activated to alert any person near that particular railroad intersection. Therefore, for the Welk disclosure to be an effective safety alert system in America's railroad system, every railroad crossing intersection in America would have this equipment installed at or near each intersection. As a consequence, the Welk disclosure suffers a number of serious drawbacks, in particular, the Welk disclosure appears to be economically infeasible due to the projected expenses in providing the necessary equipment as well as installing the equipment at each railroad intersection in America. Furthermore, the Welk disclosure also suffers from an inherent disadvantage of being prone to having vandals who could disrupt the installed equipment at any given railroad intersection.

The system for providing a warning when vehicles approach a common collision point disclosed by Fuhrmann and Friedman in U.S. Pat. No. 4,931,793 discloses a train mounted transmitter which communicates to a receiver at a given railroad intersection, so that the receiver may transmit a warning signal to any vehicle that has a responsive receiver, to indicate that the train and the vehicle are near a common collision point. Therefore, for the Fuhrmann and Friedman disclosure to be an effective safety alert system in America's railroad system, every railroad crossing intersection in America would have this equipment installed at or near each intersection. As a consequence, the Fuhrrmann and Friedman disclosure suffers a number of serious drawbacks, in particular, the Fuhrmann and Friedman disclosure appears to be economically infeasible due to the projected expenses in providing the necessary equipment as well as installing the equipment at each railroad intersection in America. Furthermore, the Fuhrmann and Friedman disclosure also suffers from an inherent disadvantage of being prone to having vandals who could disrupt the installed equipment at any given railroad intersection.

One of the advantages of the present invention is to avoid loud, blaring train horns that continually disrupt neighborhoods and lives. Another advantage of the present invention is to make available an economically feasible and electronically reliable system that can warn motorist of approaching trains while simultaneously not alerting the entire neighborhood of that approaching train. Yet another advantage of the present invention is to make available a warning system that is less prone to damage and disruption caused by vandals. At present, towns and neighborhood communities are being repeatedly being interrupted by the loud and blaring noise from train horns at all hours of the day or night, a silent warning system could effectively warn the people actually in danger, i.e., warn the motorist himself of an on-coming train. Therefore, the present invention provides a means of eliminating significant noise pollution and consequently allowing peaceful sleeping. Another advantage of the silent warning system is that it is likely to increase property values of residential homes near railroad crossing intersections.

Whether accidents are caused by the inattention of the drivers, undesirable weather conditions or inadequate traffic planning, a railroad crossing collision avoidance system is desirable which is capable of warning the motorist as well as not significantly contributing to any substantial increase to the ambient level of noise in the surrounding neighborhoods.

The present invention of a "silent" warnings system is designed to alert only the motorist approaching the railway crossings that actually need to be alerted to a present and potential danger of an on-coming train, instead of awakening the entire township in the vicinity of the railroad highway intersection.

Therefore, it can be appreciated that there exist a continuing need for new and improved safety warning system to alert motor vehicle operators of trains approaching into nearby intersections whereby minimizing any excessive noise pollution to the adjacent community. In this regard, the present invention substantially fulfills this need.

SUMMARY OF THE INVENTION

In view of the foregoing disadvantages inherent in the known types of train warning systems now present in the prior art, the present invention provides and improved safety warning system to alert the particular motor vehicle operators of any trains that may be approaching into nearby intersections while simultaneously maintaining a minimal contribution to any excessive noise to the adjacent community. As such, the general purpose of the present invention, which will be described subsequently in great detail, is to provide a new and improved "silent" train warning system that has many of the advantages of the prior art and none of the disadvantages.

To attain this, the present invention essentially comprises a safety alarm system forewarning a motor vehicle operator of a train approaching into a nearby railroad highway crossing, wherein said safety alarm system does not substantially increase the ambient noise level of the surrounding area proximate to the nearby railroad highway crossing, comprising: a transmitter mounted onto the train having: a radar emitting unit for producing a non-audible analog radar beacon signal, wherein said radar emitting unit is powered by an first electrical power supply connected to said radar emitting unit; and an electronic switch electrically connected to said radar emitting unit and connected to the first electrical power supply, wherein said electronic switch is capable of being used by the train engineer to enable and disenable said radar emitting unit from emitting the non-audible analog radar beacon signal; and a receiver mounted onto a motor vehicle having: a detector means electrically connected to a second electrical power supply, wherein said detector means is for detecting the non-audible analog radar beacon signal; and an alerting means electrically connected to said detector means and connected to the second electrical power supply, wherein said alerting means is for alerting the motor vehicle operator of the train approaching into the nearby railroad highway crossing, wherein said alerting means is an audible speaker system electrically connected to the second electrical power supply, and mounted within the passenger compartment of the motor vehicle, wherein said audible speaker system is capable of emitting an audible buzzing sound sufficiently loud for alerting the motor vehicle operator of the approaching train, and wherein said audible speaker system is for not significantly contributing to a substantial increase to the ambient noise level in the surrounding neighborhood of the nearby railroad highway crossing.

There has thus been outlined, rather broadly, the more important features of the invention in order that the detailed description thereof that follows may be better understood, and in order that the present contribution of the art may be better appreciated. There are of course, additional features of the invention that will be described hereinafter and which will form the subject matter of the claims appended hereto.

In this respect, before explaining at least one embodiment of the invention in detail, it into be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with advantages of the present invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
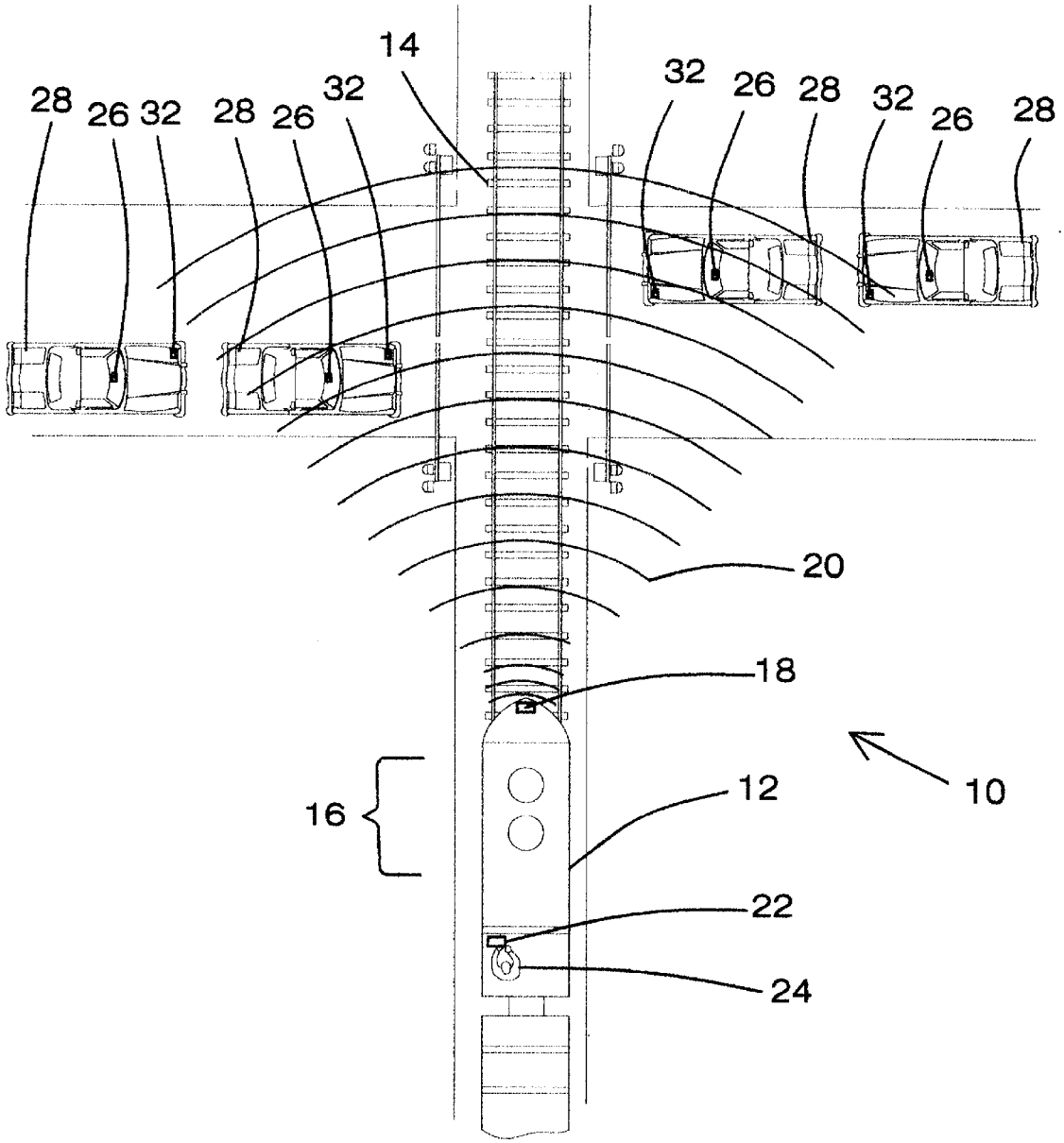
FIG. 1 a perspective view of the train noise eliminator.
Figure 2:
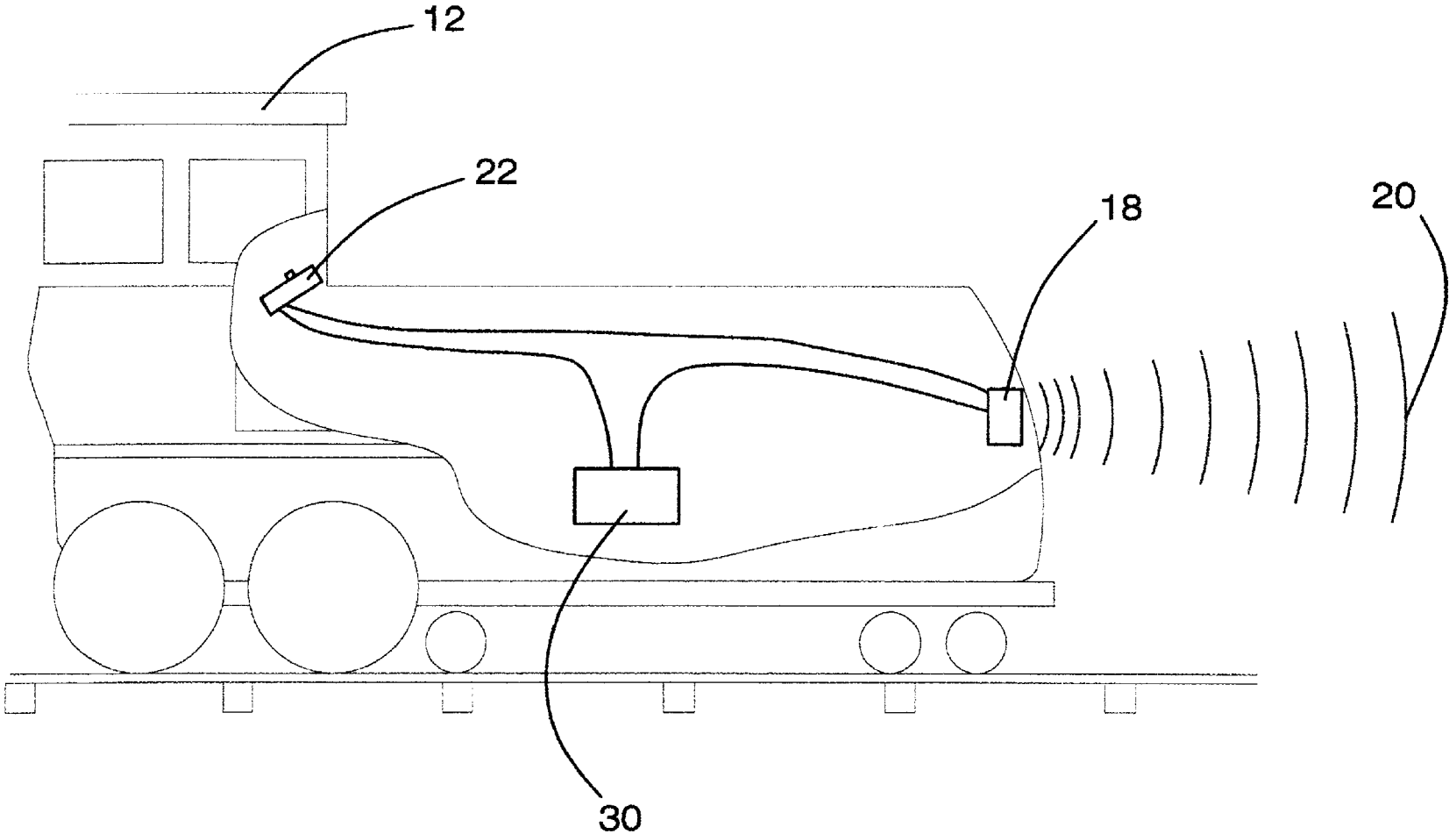
FIG. 2 is a cut away view of the transmitter element of the train noise eliminator mounted within/a train engine.
Figure 3:
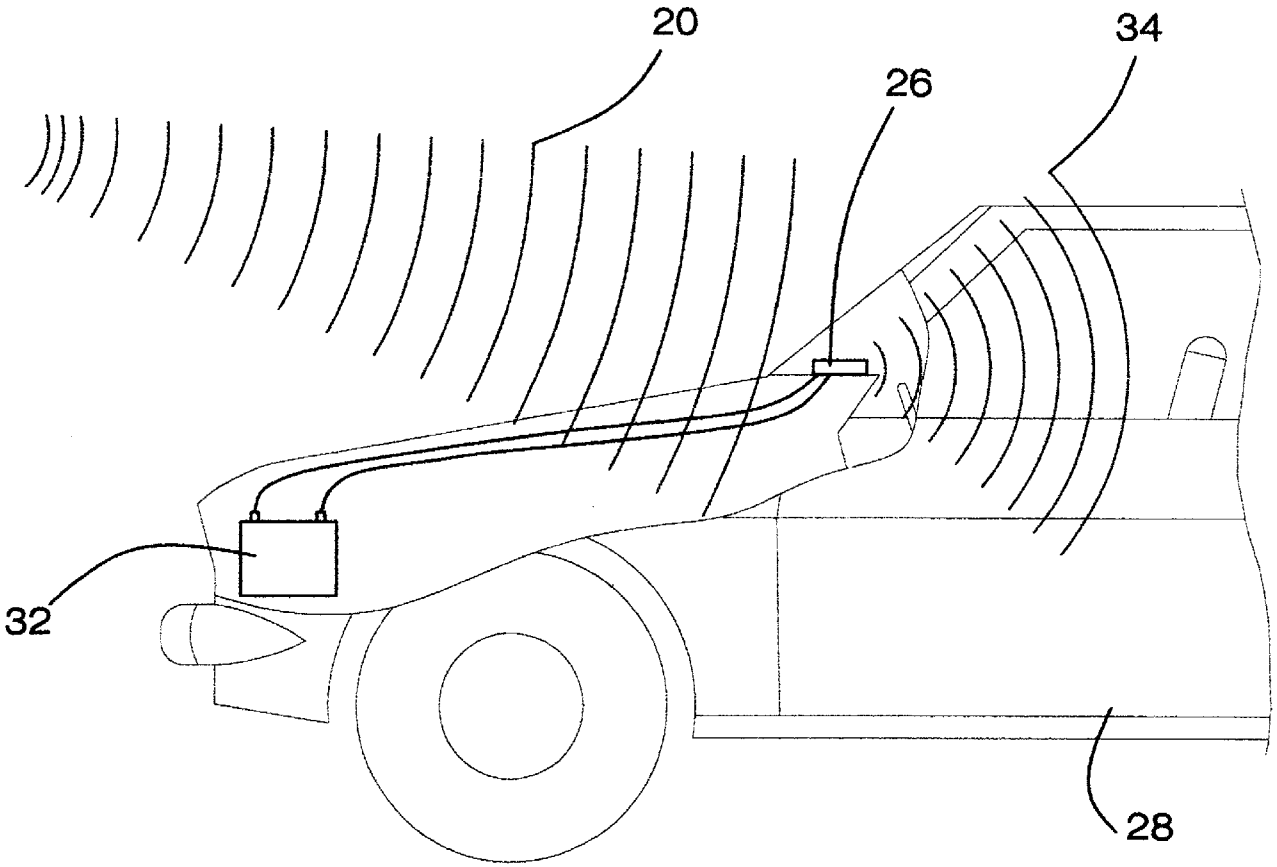
FIG. 3 is a cut away view of the receiver element of the train noise eliminator mounted within a motor vehicle.
Figure 4:
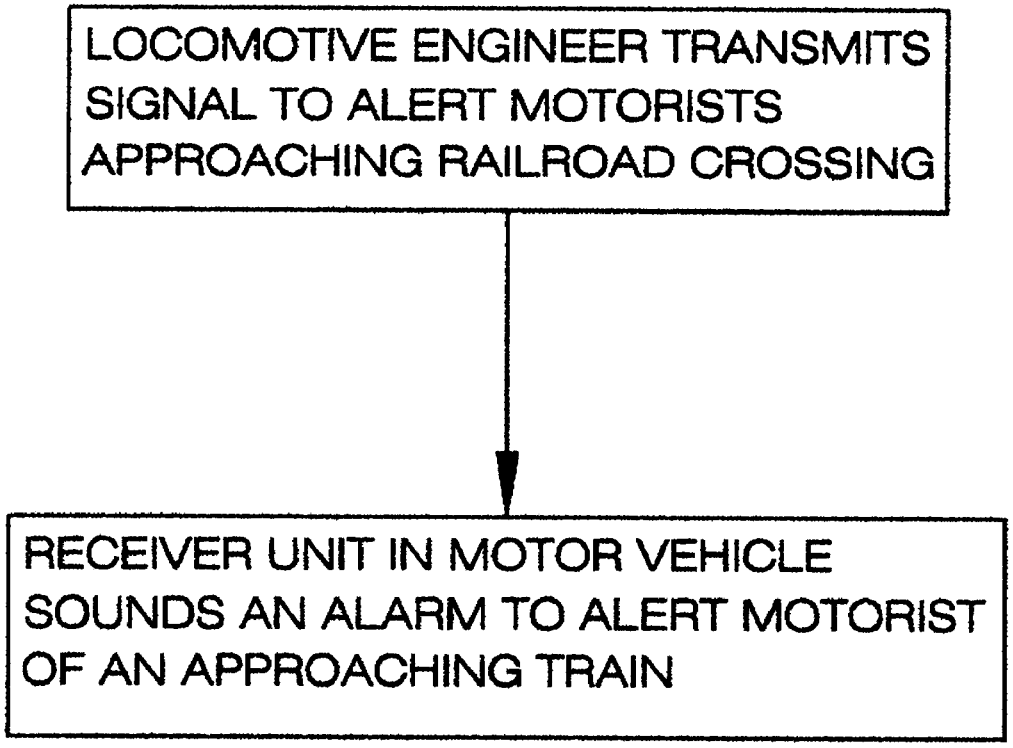
FIG. 4 is a logic a diagram of train noise eliminator.

With reference now to the drawings, and in particular FIG. 1 to 4 thereof one preferred embodiment of the present invention of a safety alarm system 10 for warning a motor vehicle operator (not illustrated) of a train 12 approaching into a nearby railroad highway crossing 14,wherein said safety alarm system 10 does not substantially increase the ambient noise level of the surrounding area proximate to the nearby railroad highway crossing 14, comprising: a transmitterl6 mounted onto the train 12 having: a radar emitting unit 18 for producing a non-audible analog radar beacon signal 20, wherein said radar emitting unit 18 is powered by an first electrical power supply 30 connected to said radar emitting unit 18; and an electronic switch 22 electrically connected to said radar emitting unit 18 and connected to the first electrical power supply 30,wherein said electronic switch 22 is capable of being used by the train engineer 24 to enable and disenable said radar emitting unit 18 from emitting the non-audible analog radar beacon signal 20; and a receiver 26 mounted onto a motor vehicle 28 having: a detector means 30 electrically connected to a second electrical power supply 32, wherein said detector means (shown here integrated as part of the receiver 26) is for detecting the non-audible analog radar beacon signal 20; and an alerting means (shown here integrated as part of the receiver 26) electrically connected to said detector means (shown here integrated as part of the receiver 26) and connected to the second electrical power supply 32, wherein said alerting means (shown here integrated as part of the receiver 26) is for alerting the motor vehicle operator (not illustrated) of the train 12 approaching into the nearby railroad highway crossing 14, wherein said alerting*means (shown here integrated as part of the receiver 26) is an audible speaker system 36 electrically connected to the second electrical power supply 32, and mounted within the passenger compartment of the motor vehicle 28, wherein said audible speaker system (shown here integrated as part of the receiver 26) is capable of emitting an audible buzzing sound 34 sufficiently loud for alerting the motor vehicle operator (not illustrated) of the approaching train 12, and wherein said audible speaker system 36 is for not significantly contributing to a substantial increase to the ambient noise level in the surrounding neighborhood of the nearby railroad highway crossing 14.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of using a safety alarm system for warning a motor vehicle operator of a train approaching into a nearby railroad highway crossing, wherein said safety alarm system does not substantially increase the ambient noise level of the surrounding area proximate to the nearby railroad highway crossing, said method comprising the steps of obtaining the safety alarm system comprising:

an analog transmitter mounted onto the train having:

a radar emitting unit for producing a non-audible analog radar beacon signal, wherein said radar emitting unit is powered by an first electrical power supply connected to said radar emitting unit; and an electronic switch electrically connected to said radar emitting unit and connected to the first electrical power supply, wherein said electronic switch is capable of being used by the train engineer to enable and disenable said radar emitting unit from emitting the non-audible analog radar beacon signal; and an analog receiver mounted onto a motor vehicle having:

a detector means electrically connected to a second electrical power supply, wherein said detector means is for detecting the non-audible analog radar beacon signal; and an alerting means electrically connected to said detector means and connected to the second electrical power supply, wherein said alerting means is for alerting the motor vehicle operator of the train approaching into the nearby railroad highway crossing, wherein said alerting means is an audible speaker system electrically connected to the second electrical power supply, and mounted within the passenger compartment of the motor vehicle, wherein said audible speaker system is capable of emitting an audible buzzing sound sufficiently loud for alerting the motor vehicle operator of the approaching train, and wherein said audible speaker system is for not significantly contributing to a substantial increase to the ambient noise level in the surrounding neighborhood of the nearby railroad highway crossing;

using the electronic switch by the train engineer to enable the radar emitting unit to emit the non-audible analog radar beacon signal from the analog transmitter mounted onto the train; detecting the non-audible analog radar beacon signal with the analog receiver mounted onto a motor vehicle having the detector means electrically connected to a second electrical power supply;

alerting the motor vehicle operator of the train approaching into the nearby railroad highway crossing with the audible speaker system by emitting the audible buzzing sound from the audible speaker within the passenger compartment of the motor vehicle when the non-audible analog radar beacon signal is detected and having the audible speaker system not significantly contributing to a substantial increase to the ambient noise level in the surrounding neighborhood of the nearby railroad highway crossing; and turning off the electronic switch by the train engineer to disenable the radar emitting unit by turning off the emitted the non-audible analog radar beacon signal from the analog transmitter mounted onto the train.

* * * * *